US005975306A

United States Patent [19]

Napier

[11] Patent Number: 5,975,306

[45] Date of Patent: Nov. 2, 1999

[54] PORTABLE KIT FOR PROVIDING A SERVICE

[76] Inventor: Phillip M. Napier, P.O. Box 11296, Portland, Me. 04104

[21] Appl. No.: 09/072,898

[22] Filed: May 5, 1998

[51] Int. Cl.[6] ..... B65D 69/00

[52] U.S. Cl. ..... 206/581; 206/486; 206/747; 190/109

[58] Field of Search ..... 206/216, 541, 206/570, 581, 372, 373, 486, 1.5, 823, 747, 749, 762, 763; 190/108, 109, 117; 220/DIG. 26, 326, 528; 312/902

[56] References Cited

U.S. PATENT DOCUMENTS

| | | | |
|---|---|---|---|
| 739,451 | 9/1903 | Schwartz | 206/372 |
| 1,417,814 | 5/1922 | Fairweather | 206/372 |
| 1,666,652 | 4/1928 | Hiering | 206/372 |
| 1,858,539 | 5/1932 | Dewey | 206/372 |
| 1,987,448 | 1/1935 | Pearson | 206/372 |
| 2,078,557 | 4/1937 | Bjorkman | 206/372 |
| 2,573,763 | 11/1951 | Graham | 206/581 |
| 3,273,700 | 9/1966 | Moreau et al. | 220/528 |
| 3,842,977 | 10/1974 | Hollander | 190/2 |
| 4,700,761 | 10/1987 | Gladding | 150/111 |
| 5,119,519 | 6/1992 | Foreman | 190/1 |
| 5,713,439 | 2/1998 | Zionts et al. | 190/102 |

*Primary Examiner*—Paul T. Sewell
*Assistant Examiner*—Nhan T. Lam
*Attorney, Agent, or Firm*—Thomas L. Bohan

[57] ABSTRACT

A kit combination for use by a commercial salesperson known as a "roving peddler," which kit has an economical design yet is of sufficient size to hold all of the necessary items for operating a business related to providing a nail-polishing service. The kit consists of a first component container shaped like a box having a specially designed internal locking mechanism, a second container shaped like a cylindrical bag, and a carrying strap affixed to the first component container. The carrying strap also has a pair of connecting rings for attaching the second component container thereto. An optional third component is a storage pillow that permits the peddler to store personal items and that also acts as a seat for the peddler while the service is being provided. The first component is a box having a box bottom with a fixed tray attached therein, and a box cover with a swivelly-attached tray. Stops are built into the first component structure to prevent any spillage of the box-cover tray contents during use or when the box is closed.

1 Claim, 2 Drawing Sheets

PORTABLE KIT FOR PROVIDING A SERVICE

BACKGROUND OF THE INVENTION

1. Field of the Invention

The present invention relates to a multi-component kit having a box combined with one or more bags containing all of the necessary articles for operating a business pertaining to toenail and fingernail painting. More particularly, the present invention has a first component of the kit having a specially-designed box for holding all of the paraphernalia such as polish, lacquer, hardener, cotton balls, polish remover, etc., for painting toenails and fingernails. The second component of the kit is a specially-designed bag for storing a tent, sleeping bag, etc., or simply foam padding, forming a pillow used as a support behind the knees of a customer. An optional third component of the kit is a specially-designed bag for storage of clothing, etc., or simple batting to form a pillow to enable the user to sit while painting. Yet more particularly, the present invention is a box/bag/pillow combination that can be easily carried, set up, and used by peddlers or hawkers as they travel from one customer to another selling their services.

2. Description of the Prior Art

Boxes and bags have been around for a very long time. There have been boxes designed for holding things such as cosmetic preparations, fingernail touch-up preparations, fishing equipment, hardware, toiletries, and various other sundry things. Each box was designed and manufactured with the specific end use in mind. Similarly, bags of various shapes and sizes have also been specially designed for carrying particular items. There are bags for holding sleeping bags, tents, groceries, luggage, and almost every conceivable item for which a carrying mechanism is needed or preferred. In addition, one can find women's purses that have a change purse attached thereto effectively making a combination or multi-component item. Also found are various, item-specific devices that incorporate a structure such as a pocket, compartment, or other such cavity used for storage purposes.

Problems associated with the currently available devices can be generally described in relation to personal versus commercial use. Those carrying devices for personal use are too fragile, too small, and otherwise inadequately designed for the purpose of quickly and easily accessing needed items. No device to this date has addressed the particular needs and requirements of the commercial salesperson identified as a "roving peddler" in operating his/her business. One of these particular needs is that for a completely self-contained kit of economical design that can hold all of the necessary components required to operate a business, have a change of clothes, and to act as a shelter, and that can be easily carried, handled, and set up by the entrepreneur.

Several attempts at designing boxes and bags of various shapes and sizes for particular purposes have been undertaken. U.S. Pat. No. 2,219,597 issued to Lutz, U.S. Pat. No. 3,537,552 issued to Noble, U.S. Pat. No. 3,971,495 issued to Velazquez, and U.S. Pat. No. 4,604,765 issued to Schultz teach such devices.

Lutz provides for a box body having a box cover, both being made of sheet metal covered with either cloth or leather, thereby providing an ornamental finish. The Lutz box contains a collapsible tray structure, which is arranged to be automatically erected to an inclined position for use or for display of articles contained therein and to be automatically restored to its seat within the box when the lid is closed. The Lutz box was specifically designed for holding cosmetic preparations and tools and the like yet makes no provision for the additional space required for storing other necessary items involved in operating a business.

Noble provides for a carrying case taking the form of a woman's handbag which is a combined purse and makeup kit. The Noble carrying case has a top and bottom cover providing access to an intermediate section containing holding compartments under each cover. This device lacks commercial usefulness because both covers cannot be opened simultaneously without having items, under one of the covers, spilling out onto the user, customer, floor, or ground if out-of-doors.

Velazquez provides for a combination camper's tent, cot, and pack frame which utilizes a light tubular telescopic frame and to which a fabric is attached for forming a tent, cot, and sleeping bag. Velazquez's combination of carrying mechanism and tent-cot-sleeping bag is a single unit taking the form of a rectangular back pack. However, Velazquez's device is not practical for use as a completely self-contained unit for operating a business because it has but one external pocket for holding supplies. This pocket provides no more advantage to the peddler/entrepreneur than a common grocery bag would provide.

Schultz provides for an article-retaining device that is a sleeping bag having a pair of padded panels folded in such a way as to provide a pocket capable of receiving articles for storage. This pocket, however, is like most pockets made of a flexible material and is not conveniently compartmentalized. Furthermore, the pocket only exists when the sleeping bag is in its folded configuration.

Therefore, what is needed is a business kit combination that is of sturdy construction capable of withstanding the rigors of everyday, commercial use. What is further needed is a business kit combination that is compact and light and is quick and easy to setup. What is still further needed is a business kit combination that is designed to hold all the required articles and components involved in operating a peddler's business. Finally, what is needed is a business kit combination that not only addresses the needs of the peddler/entrepreneur but also the comfort of the customer when buying the entrepreneur's services.

SUMMARY OF THE INVENTION

The present invention uses a combination of two or more relatively simple components specially designed to meet the business needs of a "person-to-person" service/product provider. The first component is a specially-designed container that economizes space yet is sufficient to store all of the necessary elements for operating a business of providing nail painting by a roving peddler. The second component is a specially-designed container used as a pillow support which is to be placed behind the knees of a supine customer. A third optional component is a specially-designed container used as a pillow/seat by the peddler.

The first component of the present invention is a box that includes a box cover attached to a box bottom by a continuous hinge. Unlike most boxes that have a bottom and cover, each of which basically defines an enclosed, rectangular-volumed shape, the box cover of the first component of the present invention has one side opposite the connecting hinge, which is elongated and forms one side of the closed box. This elongated side of the box cover is considered the front of the box. In the lower portion of the box stands a fixed tray along the front portion of the box. The tray consists of a horizontal element connected to support elements. The support elements effectively define a separate compartment having an open front with a closed back end for keeping whatever items are in the fixed tray segregated from any other items within the remaining portion of the box.

The fixed tray rests within and on the box bottom and is optionally secured to the sides of the box bottom through two oppositely paired support elements. The horizontal element has a plurality of equally-spaced holes which can be used for holding such things as small bottles. In perspective, the tray looks very similar to a test tube rack. The back support element of the tray defines the front wall of a rectangular-volumed storage space in the remainder of the lower portion of the box area for storing a plethora of other items. The remaining three sides of the lower portion of the box enclose this storage space.

The box cover element with the elongated side may simply be a single piece; preferably, it also has a tray incorporated in its design. This box cover tray defines its own rectangular-shaped volume complete with a cover tray bottom, two oppositely-paired parallel tray sides, and a cover tray top. It consists of a plurality of compartments of varying size. The cover tray top also has cutouts that allow for easy access to items stored within the compartments of the cover tray. The cover tray is secured to the inside of the box cover and can be swung from closed to open through a wide rotation angle. The overall design is such that it prevents any items stored within the compartments of the box cover tray from falling out into the large storage space behind the fixed tray of the lower portion of the box when the box cover is being closed.

A unique feature of the box is its locking mechanism. It automatically locks the box cover when the box cover is closed and no specially designed key is required for opening the box thereafter. A simple pencil, pen, or rod, similar in size to a pencil, will unlock the cover. This alleviates the peddler/entrepreneur's concern that a lost key will prevent the peddler's ability to conduct business while maintaining security for the peddler's wares. It is to be understood that the box can be made of wood, sheet metal, thermoplastic, or any similarly rigid material, or any combination thereof.

The second component of the present invention is a bag having a special size and shape to comfortably fit behind the knees and to support the legs of a person at a proper angle so that nail painting may be provided to that person. The bag is optionally connectable to a carrying strap of the box previously described using any type of release clips for easy separation and application. The bag includes a zippered opening and it can be filled not only with foam padding, but can alternatively be used for storing a tent, sleeping bag, etc., or any other desired item useful to a roving peddler. The bag can be made of a variety of soft, pliable materials such as leather, vinyl, nylon, cloth or any combination thereof. A second optional pillow or storage bag is preferably included to provide resting support to the service provider, and storage of a change of clothes and any other items that the peddler wishes to carry.

In use, the present invention would be carried by the roving peddler using the invention's shoulder strap. Upon soliciting a customer for a painting, for example, the entrepreneur would unsnap the padded bag from the shoulder strap and place it behind the knees of the customer. The size and shape of the bag is such that, when placed behind the knees of the customer, the customer's feet are positioned in an essentially horizontal, forward-pointing position making the performance of the nail-painting service convenient and easy. Next, the entrepreneur would place the box on the ground and open it using a pencil, pen, or rod of similar size and shape. The rod would be inserted into a hole on the front of the box thus releasing the locking mechanism. The box cover is then lifted to its full open position and the box cover tray is pulled forward to its pre-set stop position. The peddler/entrepreneur is then ready to proceed with the customer-purchased service, preferably using the third component—the storage pillow—as a convenient means of resting while providing the service.

In summary, the present invention is different from all of the previous devices and has distinct advantages found in its design. It preferably features three components: a box, a bag, and a storage pillow, each of which may be used separately or that may be combined into a single kit that economically maximizes the efficient use of a minimal amount of space and that is easy to use and to handle. The box is designed to be sufficiently sturdy to withstand the rigors of commercial use. It also incorporates a combination of a fixed tray, a pivoting tray, and a cavity for holding other essential elements of the kit. The bag design, which may be a second component of the present invention, is of a particular shape and size to comfortably accommodate and support the knees of a customer when a nail painting is being performed using components stored in the box described. The bag may simply be foam-filled or it may be filled with all of the items a lightly-equipped traveling salesperson needs. The third component is the storage pillow that is designed to ease the peddler's position while performing the service and to provide storage space. These and other advantages of the present invention will become evident upon review of the drawings, detailed description, and the claims of the present invention.

DETAILED DESCRIPTION OF THE PREFERRED EMBODIMENT

Figure 1:
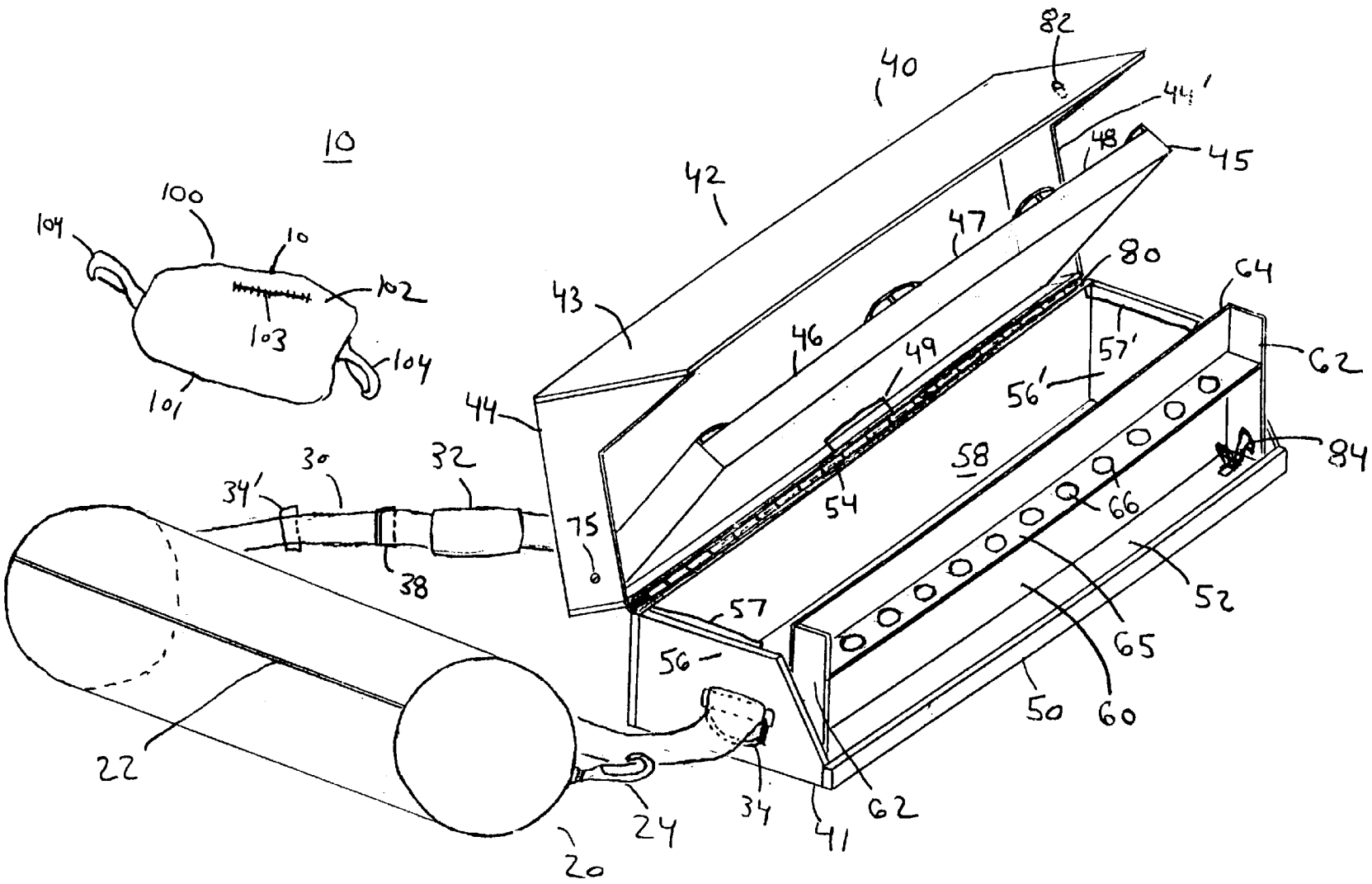
FIG. 1 is a perspective view of the present invention showing the box component in its fully opened position with the cover tray pulled forward, the bag component, and the storage pillow.

The general arrangement of the preferred embodiment of the present invention is illustrated in FIG. 1 which shows a business kit combination 10 which includes a first component 40, a second component 20, and an optional, although preferred, third component 100.

The first component is a box 40 having a box cover 42 connected to a box bottom 50 by a continuous hinge 80. The box bottom 50 has a bottom panel 52, a back panel 54, and a pair of opposed bottom side panels 56 and 56'. Each of the opposed side panels 56 and 56' has a similar 45° angle cut on one edge corresponding to similar cuts in the box cover 42 to be described herein. There is preferably no separate bottom front panel; however, it may be possible to fabricate the present invention with such a separate panel. A fixed tray 60 is located towards a front edge 41 of the box bottom 50. The fixed tray 60 has support means, including a pair of opposed fixed-tray side support elements 62 and 62', a fixed-tray back support element 64, and a fixed-tray horizontal support element 65 having a plurality of holes 66. The horizontal support element 65 is approximately 1 to 1½ inches wide running for almost the entire length of the box 40 parallel to and at a distance of approximately 3 inches above the bottom panel 52. In this particular embodiment, the fixed tray 60 resembles a test tube rack and is higher than the opposed bottom side panels 56 and 56'. This design permits storage of nail polish so that it will not rattle about or fall out of the box 40 when the box 40 is closed and moving. Of course, the size and number of holes 66 may be set by the box user or the box maker. The fixed tray back support element 64 in conjunction with the bottom back panel 54, and the pair of opposed bottom side panels 56 and 56' effectively enclose a space 58.

The box cover 42 has an elongated, front panel 43 and a pair of opposed side cover panels 44 and 44'. The pair of opposed side cover panels 44 and 44' are cut at a 45° angle to match the side bottom panels 56 and 56' when the box cover 42 is in the closed position as previously indicated. In this embodiment, the box cover 42 also has a rotating upper tray 45 swivelly-attached to the box cover 42. The rotating upper tray 45 has three separate compartments 46, 47, and 48, respectively for storing items. The rotating tray 45, which has a built-in stop 49, rotates within a 60° angle such that, when the box cover 42 is fully open, the rotating tray 45 opens away from the box cover 42 towards the interior of the box to a 50° angle with respect to the box bottom 50. It is obvious from the present discussion that the box cover 42 swings from its closed to its opened position through an approximate 110° angle. The opposite, mirror-imaged side panels 56 and 56' of the box bottom 50 also have built-in stops 57 and 57' in order to keep the rotating upper tray 45 parallel to the box bottom panel 52 when the box cover 42 is in the closed position, thereby preventing a spilling out of any contents within any of the compartments 46–48, when the box cover 42 is closed.

Figure 2:
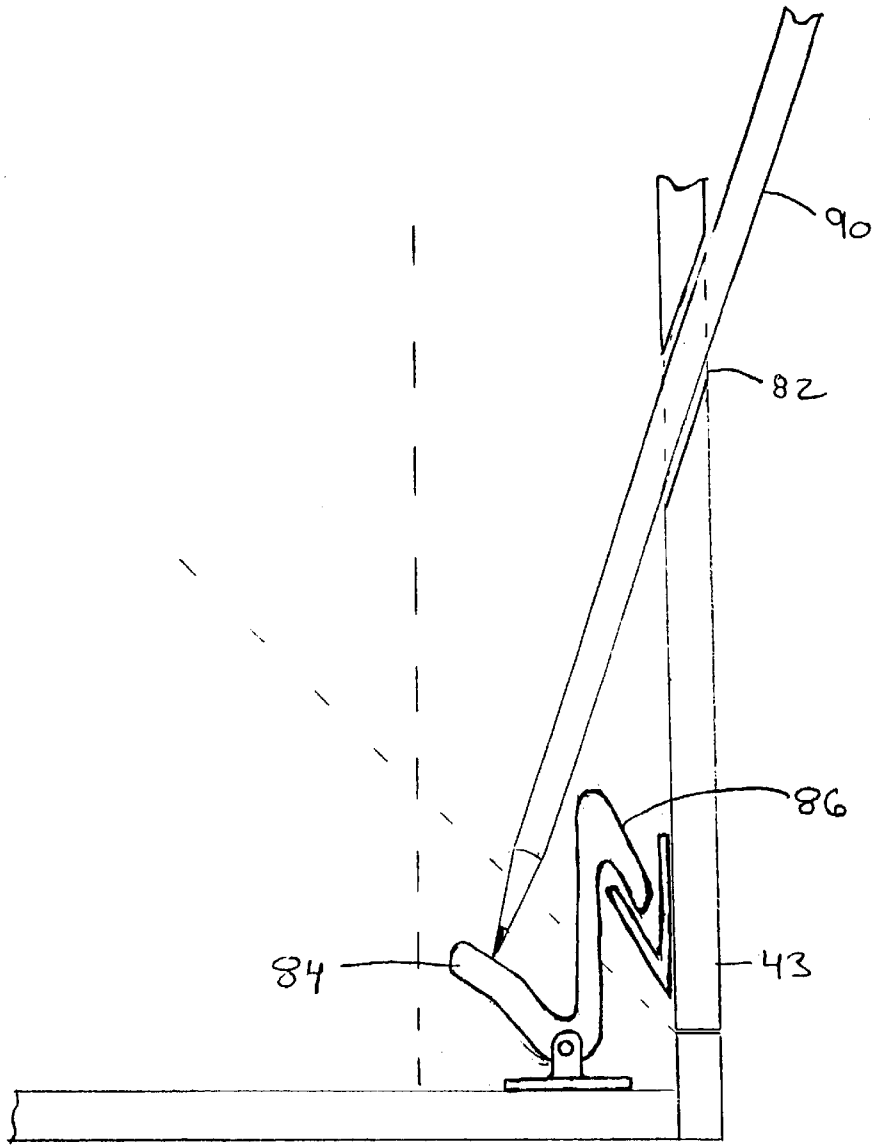
FIG. 2 is an enlarged, cross-sectional view of the locking mechanism of the present invention showing a pencil passing through an access hole in the front of the box component and engaging the lock.

FIG. 2 clearly shows a key feature of the present invention, means for securing the box 40 when closed. An access hole 82 in front panel 43 is shown through which an internal locking mechanism 84 can be released from a locking clip 86. No specially designed key is required for opening the box; a simple pencil, pen, or rod similar in size to a pencil 90 can be used to unlock the box cover 42. The box 40 automatically locks when the box cover 42 is closed. While such a design may have been considered in the past in other unrelated fields, it is novel in the context of the present invention.

Turning back to FIG. 1, a shoulder strap 30 is connected to the bottom side panels 56 and 56'. A variety of means can be used for securing the shoulder strap 30 to the box 40. A pair of connecting rings 34 and 34' are integrally attached to the shoulder strap 30. The second component, a bag 20, of the kit 10 may also be attached to the connecting rings 34 and 34' via two quick-release clips 24 that are permanently affixed to opposite ends of the bag 20. The strap 30 is preferably fabricated of a light-weight, strong material such as nylon and includes adjustment means 38 so that the user can adjust the combination of components of the kit 10 to his or her liking.

The bag 20 of the present invention has a cylindrical shape and can be filled with foam padding or it can be used to store items such as a tent, a sleeping bag, and/or any other materials the user wishes to insert. Access to the inside of the bag 20 is accomplished through a zippered opening 22. In the preferred embodiment of the invention the bag 20 is approximately nine inches in diameter so that when paced under the knees of a customer laying down on his or her back, his or her toes will be essentially parallel to the ground. The third component 100 is an optional storage pillow 100 designed to be both a seat for the service provider and as a means for traveling peddler to easily stow suitable items of interest. The storage pillow 100 may simply be a bag having a durable and weather-resistant underside 101 and a relatively soft upper side 102 having an interior-entry means such as a zipper 103. The storage pillow 100 preferably includes a detachably pillow clasp 104 on each end for releasable attachment to the strap 30.

In use, the kit 10 would generally be carried by a commercial salesperson using the shoulder strap 30. A padded shoulder pad 32, which is attached to the shoulder strap 30, can be used to make carrying the kit 10 more comfortable. After soliciting a customer, the salesperson would release the bag 20 from the shoulder strap rings 34 and 34' and place the bag 20 behind the knees of the customer. Next, the salesperson would release the locking mechanism 84 from the locking clip 86 using the pencil 90 or the like. The box cover 42 is then fully opened and the rotating upper tray 45 is pulled forward exposing its contents to the salesperson. In final preparation to begin providing the service, the salesperson would unclasp the storage pillow 100 and arrange that on the underlying surface to act as a seat. At this point, the rotating upper tray 45, the fixed tray 60, and the storage space 58, along with all of the items required by the salesperson contained therein, are handy and easily accessible for performing the customer-procured service. When finished, the salesperson simply closes the box cover 42. The stops 57 and 57' prevent any items stored within the compartments 46, 47, and 48 of the rotating tray 45 from falling out into the large storage space 58 behind the fixed tray 60 of the box bottom 50 when closing the box cover 42. The box cover 42 automatically locks in place by means of the locking mechanism 84. The salesperson then attaches the bag 20 to the shoulder strap connecting rings 34 and 34' via the quick-release clips 24, and carries the kit 10 on to the next customer.

Although the preferred embodiment of the present invention has been described in some detail herein, it is to be understood that this description is merely illustrative. The inventive apparatus may be modified in a variety of ways to suit a particular purpose while still employing the unique concepts set forth in the SUMMARY.

What is claimed is:

1. A combination kit for providing nail polishing comprising:

a. a first component container comprising a box bottom having a fixed tray and an internal locking mechanism attached therein, a box cover hingedly secured to said box bottom, said box cover having an elongated side opposite said hingedly securing means and a swivelly-attached tray, and securing means for attaching a carrying strap;

b. a second component container comprising a cylindrically-shaped bag having a pair of quick-release clips attached thereto and an opening for access to an interior of said bag;

c. a third component container comprising a storage pillow having a pair of quick-release clips attached thereto and an opening for access to an interior thereof; and d. a carrying strap affixed to said first component container and having a pair of connecting rings attached thereto for attaching said second and third component quick-release clips.

* * * * *